United States Patent [19]

Tomioka et al.

[11] 4,190,396

[45] Feb. 26, 1980

[54] SODIUM TURBINE PUMP

[75] Inventors: Shunzo Tomioka; Masaaki Nakano, both of Hitachi; Akira Suzuki, Tokyo; Shizuichi Sakamoto, Shimoinayoshi, all of Japan

[73] Assignee: Hitachi, Ltd., Japan

[21] Appl. No.: 778,089

[22] Filed: Mar. 16, 1977

[30] Foreign Application Priority Data

Mar. 19, 1976 [JP] Japan ..... 51-29215

[51] Int. Cl.[2] ..... F01D 11/00

[52] U.S. Cl. ..... 415/110; 417/424; 415/170 R

[58] Field of Search ..... 418/110, 111, 112, 106, 418/168, 169 R, 172; 417/424; 415/170 A, 170 B

[56] References Cited

U.S. PATENT DOCUMENTS

| | | | |
|---|---|---|---|
| 1,337,659 | 4/1920 | Kerr | 415/106 |
| 1,374,664 | 4/1921 | Kerr | 415/106 |
| 2,921,533 | 1/1960 | Williams | 415/112 |
| 3,671,137 | 6/1972 | Ball | 415/111 |
| 3,871,789 | 3/1975 | Lameris | 415/111 |
| 3,910,714 | 10/1975 | Allen et al. | 415/111 |

FOREIGN PATENT DOCUMENTS

| | | | |
|---|---|---|---|
| 2443204 | 4/1976 | Fed. Rep. of Germany | 415/110 |

*Primary Examiner*—Husar C. J.

*Attorney, Agent, or Firm*—Craig and Antonelli

[57] ABSTRACT

An impeller secured to a shaft in a vertical type sodium turbine pump is interposed between a suction tube and an impeller casing. A mouth ring in an impeller is positioned in the close proximity of a lower ring secured to the suction tube, while an impeller ring protruding from a crown ring is positioned in the close proximity of an upper ring secured to an impeller casing, with a given clearance maintained therebetween.

Pockets are provided in the surface of the mouth ring positioned close to the lower ring as well as in the surface of the impeller ring positioned close to the upper ring, so that there may be produced a static bearing action by molten sodium between the mouth ring and the lower ring, as well as between the impeller ring and the upper ring.

9 Claims, 5 Drawing Figures

SODIUM TURBINE PUMP

BACKGROUND OF THE INVENTION

This invention relates to a sodium turbine pump, and more particularly to a vertical type sodium turbine pump.

A circulating pump using sodium as an intermediate heat medium is used for a fast breeder type atomic power plant. In this pump, the molten sodium is maintained at a temperature as high as 450° C., and sodium becomes radioactive due to absorption of neutrons, so that a turbine pump finds its application as a circulating pump for this purpose. In this respect, a heat or radioactivity shielding member is disposed between a body proper of the pump and a drive means thereof, and a relatively long shaft has to be used for the pump.

As has been described earlier, a fluid to be driven by the sodium turbine pump is used for lubrication for a bearing.

The coefficient of viscosity of molten sodium is as low as 1/125 of that of turbine oil.

With a hydrodynamic bearing of an ordinary type, a load capacity of a film bearing is proportional to the square of a shaft diameter and a coefficient of viscosity of the fluid, but in inverse proportion to the square of a bearing clearance.

Accordingly, for obtaining the same load capacity as that of turbine oil in a hydrodynamic bearing, the bearing clearance should be reduced to about 1/14.6

$$\left(\frac{1}{\sqrt{215}}\right),$$

or the radius of the shaft should be increased to about 14.6 times ($\sqrt{215}$).

The former leads to a difficulty in a manufacturing technique, while the latter leaves a problem in manufacturing cost. As a result, a static-pressure bearing utilizing a discharge pressure from the pump is adopted for a sodium turbine pump. A sodium piping is directly connected to the bottom of a casing of a prior art vertical type sodium turbine pump. On the other hand, a sodium outlet nozzle is directly connected to another sodium piping.

An impeller is secured to the lower end of a shaft in a sodium turbine pump, while a sodium-suction side of the impeller is connected by way of a suction tube to a sodium pipe. A suction tube surrounds a mouth ring in an impeller.

An impeller casing consists of a cylindrical portion encompassing the impeller ring which extends from the impeller upwards in a cylindrical form, and a pan-shaped portion extending radially from the cylindrical portion towards the casing and shaft, with the shaft extending through the center of the pan-shaped portion.

A seal ring made of a stainless steel is disposed between the impeller casing and the casing, thereby sealing sodium tending to leake therebetween.

A bearing secured to the shaft provides a given clearance to a cylindrical portion of the impeller casing. Two or more holes extend through the cylindrical portion so as to permit part of sodium discharged from the pump to be supplied from outside of the cylindrical portion to the sliding surface of a bearing.

A diffuser is secured to an outer periphery of a discharge port of the impeller, with the opposite sides thereof being secured to the impeller casing and the suction tube.

A clearance between the impeller ring and the impeller casing as well as a clearance between the mouth ring and the suction tube are set to relatively small values so as to seal the sodium as tightly as possible. In like manner, a clearance between the sodium discharge portion of a impeller and the diffuser is set to a relatively small value for the same reason.

Since sodium flows through the respective clearances contiguous to the aforesaid bearing surface and sealing surface on a Poiseuille flow pattern, so that the flow rate of sodium leaking through the clearance is increased or decreased in proportion to a supply pressure of sodium and to the cube of a clearance on a bearing surface, sealing surface or the like, but in inverse proportion to the width of a land (a peripheral contacting surface excluding pockets for the bearing) which is provided on the bearing surface.

The following drawbacks are experienced with the prior art sodium turbine pump:

(1) Lowered volumetric efficiency of a pump

A clearance, through which sodium is circulated, is provided on the bearing surface at one position, and on the sealing surface in two positions, thus providing many clearances, so that a circulating flow rate of sodium becomes a loss, with the result that a volumetric efficiency which is a ratio of a suction flow rate of processed sodium to a delivery flow rate of sodium, is lowered.

(2) The construction of a pump is complex and a manufacturing cost thereof is high (3) Assembly, set-up and adjustment of a pump are difficult Since sodium to be processed is maintained at a high temperature and a long shaft has to be used, there results unwanted elongation of the shaft due to the use of high temperature sodium, thereby causing warping and an eccentric rotation of the shaft, with the accompanying metal-to-metal contact of a sliding surface of the bearing surface. A need to prevent or minimize the aforesaid metal-to-metal contact renders assembly, set-up and adjustment of the pump difficult.

(4) Remarkable vibrations take place in a pump and thus its maintenance is encountered with difficulty:

The inflow of molten sodium pressurized by an impeller to the bearing surface and sealing surface exerts a complex vibratory force on the impeller. This vibratory force further promotes the vibrations due to the warping and eccentric rotation of the shaft, which may be attributed to the use of high-temperature molten sodium.

SUMMARY OF THE INVENTION

It is an object of the present invention to provide a sodium turbine pump providing a high volumetric efficiency.

It is another object of the present invention to provide a sodium turbine pump which is compact in size and low in manufacturing cost.

It is a further object of the present invention to provide a sodium turbine pump which allows easy assembly, set-up and adjustment.

It is a still further object of the present invention to provide a sodium turbine pump which minimizes vibrations accruing from the flowing of sodium serving as a fluid to be processed.

According to the present invention, an impeller ring and mouth ring in an impeller are covered from outwardly with a suction tube having an impeller casing formed with an upper ring as well as with a suction tube formed with a lower ring, with a given clearances maintained therebetween. These clearances are utilized as static pressure bearings for supporting the impeller, while molten sodium supplied in pressurized condition due to the rotation of the impeller is used as a lubricant.

DESCRIPTION OF THE PREFERRED EMBODIMENTS

The present invention will now be described in more detail with reference to the accompanying drawings which indicate the embodiments of the invention.

Figure 1:
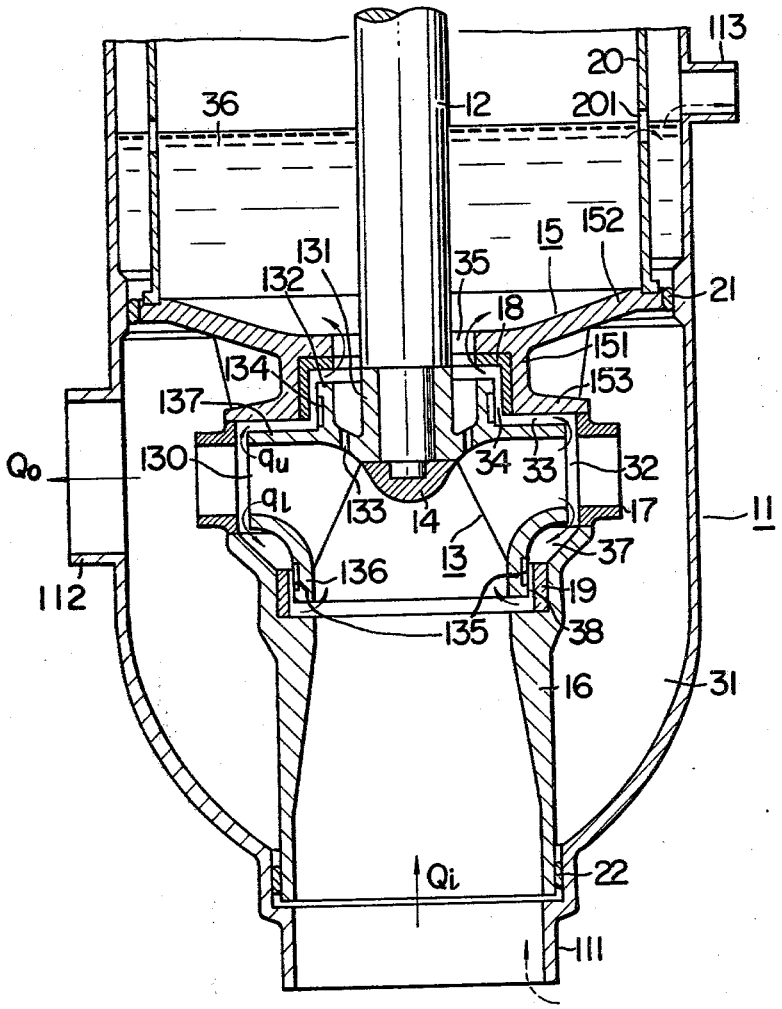
FIG. 1 is a partly longitudinal cross sectional view showing one embodiment of a sodium turbine pump according to the present invention.

Referring to FIG. 1, a drive means (not shown) adapted to rotate a shaft 12 in a casing is mounted on top of a casing 11.

A boss portion 131 of an impeller 13 is fitted on the tip portion of a shaft 12, and the impeller 13 is secured to the tip of the shaft 12 by means of an impeller nut 14. The impeller 13 includes a boss portion 131 contacting the shaft 12, a crown ring 137, an impeller ring 132 which is cylindrical and extends from the crown ring 137 along the shaft 12, a mouth ring 136, and two or more vanes 130 disposed radially between the crown ring 137 and the mouth ring 136.

Two or more balancing holes 133 are provided between the boss portion 131 and the impeller ring 132 for balancing the pressures acting on the front and back surfaces of the impeller, thereby reducing a thrust load.

The impeller casing 15 includes a cylindrical portion 151 surrounding the impeller ring 132, a flange portion 153 extending from the lower edge of the cylindrical portion 151 along a crown ring 137 outwardly, with a narrow crown chamber 33 defined between the crown ring 137 and the flange portion 153, and a pan-shaped portion 152 extending from the upper edge of the cylindrical portion 151 in the direction between the shaft 12 and the casing 11. A balancing chamber 35 is defined between the pan-shaped portion 152 and the shaft 12.

The mouth ring 136 is surrounded with the suction tube 16, with a relatively narrow band chamber 37 defined therebetween. The suction tube 16 is positioned between the mouth ring 136 and an inlet nozzle 111 provided in a bottom portion of the casing 11. The suction tube 16 defines a passage, through which to supply molten sodium, which has been supplied externally of the casing 11, through the inlet nozzle 111 into the mouth ring 136.

A diffuser 17 is positioned around the periphery of vanes 130, with a given clearance, i.e., an impeller outer clearance 32 being defined therebetween, while the upper and lower sides of the diffuser 17 are secured to the impeller casing 15 and suction tube 16, respectively.

Flame-sprayed over the surface of the impeller casing 15, which is opposed to the impeller ring 132, is a self-fluxing alloy of a high Ni system and a high abrasion resistance which is provided for its contact with the impeller ring 132 during the operation of a pump, the aforesaid self-fluxing alloy forming an upper ring 18.

Likewise, a flame-sprayed over the surface of the suction tube 16 for the same purpose as above is a self-fluxing alloy providing for its contact with the mouth ring 136, the aforesaid self-fluxing alloy forming a lower ring 19.

Two or more hydrostatic pressure pockets 134 and 135 and provided in the outer peripheral surfaces of the impeller ring 132 and mouth ring 136, respectively, which surfaces are directed towards the upper ring 18 and lower ring 19, the aforesaid pockets 134 and 135 being arranged in the circumferential directions of the rings 132, 136, respectively.

The lower end of hydrostatic pressure pocket 134 extends to a position lower than the lower end of the upper ring 18. On the other hand, the upper end of the hydrostatic pressure pocket 135 extends to a position higher than the upper edge of the lower ring 19. These pressure pockets 134, 135 are so designed as to extend a sufficient distance or length from the upper edge of the lower ring 19 upwards, and from the lower edge of the upper ring 18 downwards, so that despite the axial shifting of the impeller ring 132 and mouth ring 136 along the shaft 12 due to the elongation of the shaft 12 which is caused by high-temperature sodium during the operation of a pump, the widths of lands on the bearing surfaces of the impeller ring 132 and mouth ring 136 (i.e., the width obtained from the entire width of the circumferential contacting surface less the width of a hydrostatic pressure pocket) may be maintained constant.

According to this arrangement, the flow rate of Poiseuille flow may be maintained constant, by maintaining the width of the land of the aforesaid bearing surface constant, because the flow rate of a Poiseuille flow is increased or decreased in proportion to the width of the land.

An upper lubricating clearance 34 and a lower lubricating clearance 38 are provided between the impeller ring 132 and the upper ring 18, and between the mouth ring 136 and the lower ring 19, respectively.

An upper seal ring 21 and a lower seal ring 22 which are made of an austenitic stainless steel are fitted between a pan-shaped portion 152 of the impeller casing 15 and the casing 11, and between the suction tube 16 and the casing 11, respectively, thereby sealing up sodium.

An inner casing 20 is provided for supporting the impeller casing 15, diffuser 17 and suction tube 16 on a mount for use with a drive means adapted to drive the shaft 12. The lower end portion of the inner casing 20 is secured to the pan-shaped portion 152 of the impeller casing 15, and the impeller casing 15 is of a cylindrical shape which is concentric with the casing 11.

An outlet nozzle 112 is provided on the casing 11 in a position close to the diffuser 17.

A space encompassed with the impeller casing 15, diffuser 17, suction tube 16 and casing 11 will be referred to as a high pressure chamber 31. In contrast thereto, a space encompassed with the pan-shaped portion 15, inner casing 20 and a mount for use with a drive means (not shown) will be referred to as a low pressure chamber 36.

Provided in the casing 11 above the impeller casing 15 is an overflow nozzle 113, while two or more over flow holes 201 are provided in the inner casing 20 at a level lower than the over-flow nozzle 113.

Description will be given of the operation of the sodium turbine pump according to the present invention.

Referring to FIG. 1, the shaft 12 and the impeller 13 secured to the shaft 12 are rotated by means of a drive means (not shown). Sodium is introduced through the inlet nozzle 111, and suction tube 16 into the impeller 13 (at a flow rate of Qi) and then discharged through the diffuser 17 into the high pressure chamber 31 in the casing 11, and then through the outlet nozzle 112 outside.

There takes place a reduction in pressure of sodium, with the rotation of the impeller 13, in the upper lubricating clearance 34 as well as in the lower lubricating clearance 38 defined between the impeller ring 132 and the upper ring 18, and between the mouth ring 136 and the lower ring 19, respectively.

Part of sodium pressurized due to a pumping action flows (at a flow rate qu) through the impeller outer clearance 32 between the impeller 13 and the diffuser 17, and then by way of the crown chamber 33, upper lubricating clearance 34 and balancing chamber 35, in response to the reduction in pressure of sodium in the aforesaid clearances. Another part of sodium (flow rate qu) reaches the lower pressure chamber 36. A still another part of sodium (flow rate qu) is delivered by way of the balancing hole 133 into the impeller 13.

On the other hand, part of the aforesaid molten sodium thus pressurized circulates by way of a band chamber 37, and lower lubricating clearance 38 (flow rate ql), and then to the suction side of the impeller 13 through the vanes 130.

The flow rates qu, ql of sodium are regarded as a loss or leakage, affecting a volumetric efficiency of the pump. More particularly, the flow rate $Q_o$ of sodium being delivered out through the outlet nozzle 112 is Qi - qu - ql, while the volumetric efficient $\eta v$ (%)=[(Qi - qu - ql)/Qi]×100.

Sodium leaking into the lower pressure chamber 36 is accumulated in the chamber 36, as the time goes on, then returned through the overflow holes 201 in the inner casing 20, and then through the overflow nozzle 113 in the casing 11 by way of a pipe (not shown) back to the suction side of a sodium turbine pump.

Table 1 shows the results of comparison of calculated flow rates of sodium in the prior art sodium turbine pump versus the pump according to the present invention.

A clearance ratio of fit for a prior art bearing portion is taken as 1.5/1000 for achieving a desired function of a static pressure bearing, while clearance ratios of fit for the impeller ring portion and mouth ring portion are taken as 3/1000 which is a doubled value of 1.5/1000 for providing for an accident of contact.

Table 1

| ratios & efficiency | portion | dimension | Prior art | Present invention |
|---|---|---|---|---|
| clearance ratio of fit | bearing | $\frac{Cb}{Db}$ | $\frac{1.5}{1000}$ for bearing | — |
| | impeller ring | $\frac{Cu}{Du}$ | $\frac{3.0}{1000}$ for sealing | $\frac{1.5}{1000}$ for bearing |
| | mouth ring | $\frac{Cl}{Dl}$ | $\frac{3.0}{1000}$ for sealing | $\frac{1.5}{1000}$ for bearing |
| leakage percent | bearing | $\frac{qb}{Qi} \times 100$ | 2.0 | — |
| | impeller ring | $\frac{qu}{Qi} \times 100$ | 10.0 | 3.0 |
| | mouth ring | $\frac{ql}{Qi} \times 100$ | 10.0 | 3.0 |
| volumetric efficiency (%) | | $\frac{Qo}{Qi} \times 100$ | 78.0 | 94.0 |

The clearance ratio of fit is based on the diameter of the inner ring in a bearing portion or sealing portion, while the leakage percent is based on the flow rate of sodium into the suction side of a pump. (See FIG. 1), wherein Cb: width of a clearance in the bearing portion
Cu: width of a clearance in the impeller ring portion
Cl: width of a clearance in the mouth ring portion
Db: diameter of the inner ring in the bearing portion
Du: diameter of the sealing or inner ring in the bearing in the impeller ring portion
Dl: diameter of the sealing or inner ring in the bearing in the mouth ring portion
qb: leakage from the bearing portion
qu: leakage from the impeller ring portion
ql: leakage from the mouth ring portion
Qi: flow rate of sodium at the entrance of the suction tube
Qo: flow rate of sodium being discharged through the outlet nozzle (=Qi-qb-qu-ql)

According to the prior art pump, there are one bearing portion and two sealing portions, while two bearing portions are provided in the present invention, so that a degree of overhang of bearing portions may be moderated according to the present invention, so that a clearance ratio of fit according to the present invention is set to 1.5/1000 both for the impeller portion and for the mouth ring portion.

As a result, the leakage percent according to the prior art pump is found to be 2% for the bearing portion and 10% both for the impeller ring portion and for the mouth ring portion. In contrast thereto, a leakage percent according to the pump of the present invention is found to be 3% both for the impeller ring portion and for the mouth ring portion.

Accordingly, a volumetric efficiency of 94% is attained according to the present invention, while a volumetric efficiency of 78% is attained according to the prior art pump, resulting in an improvement of 16%.

Figure 2:
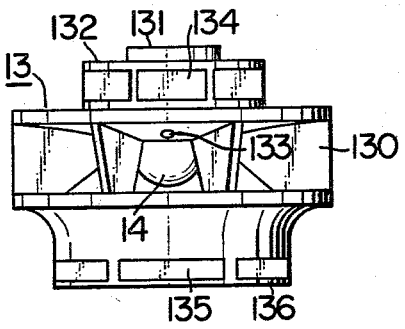
FIG. 2 is a side view of one embodiment of an impeller in the sodium turbine pump according to the present invention.

FIG. 2 is a side elevation of the impeller 13 and impeller nut 14. In this embodiment, vanes 130 and hydrostatic pressure pockets 134, 135 are spaced equally in the circumferential direction, and six vanes and pockets are provided, respectively.

Figure 3:
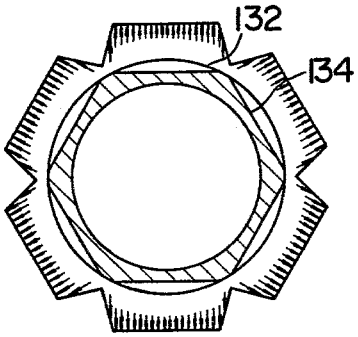
FIG. 3 is a diagrammatic view of bearing loads acting on an impeller ring in the sodium turbine pump according to the present invention.
Figure 4:
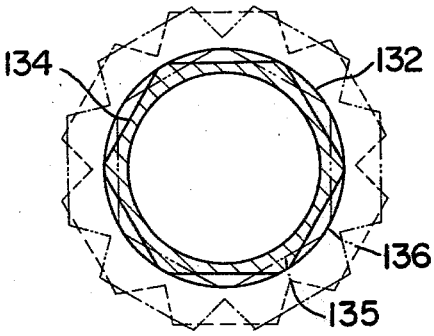
FIG. 4 is a diagrammatic view of one embodiment of the sodium turbine pump according to the present invention, showing bearing loads acting on an impeller ring and mouth ring.

There appears a pressure distribution as shown in FIG. 3 on a bearing surface of the impeller ring 132 in the circumferential direction thereof. In other words, a reaction by a film of sodium, which is dependent on the width of a land of the impeller ring, acts on the surface of the land. As a result, a reaction between adjoining pockets is reduced. (See FIGS. 2 and 3). The reaction likewise acts on a bearing surface of the mouth ring 136. In case relative positions of the hydrostatic pressure pockets 134, 136 are shifted half pitch, then there takes place no partial overlap of pressure in the circumferential direction as shown in FIG. 3, but these pressures appear as a composite pressure of pressures shown by a broken line and a one-point chain line in FIG. 4, presenting a pressure distribution equalized in the circumferential direction. As a result, a vibratory force of the impeller 13 is neutralized, thereby reducing vibration of a pump during its operation.

Figure 5:
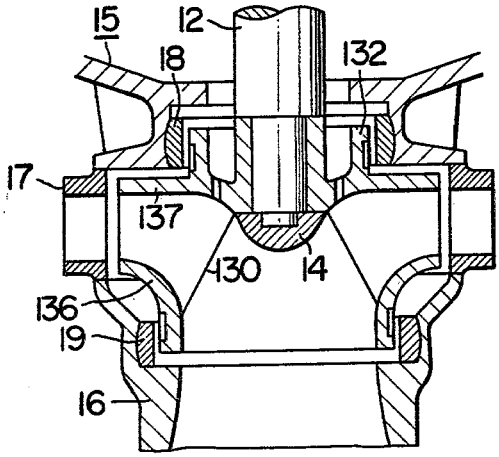
FIG. 5 is a partly cross sectional view of another embodiment of the sodium turbine pump according to the present invention.

FIG. 5 is a view of still another embodiment of the sodium turbine pump according to the present invention, which provides a large capacity.

As shown in FIG. 5, in place of the upper ring and lower ring which are prepared according to the flame spraying of a self-fluxing alloy, as shown in FIG. 1, the upper ring 18 and the lower ring 19 are provided in the form of a cylinder and made of the aforesaid self-fluxing alloy presenting convex outer peripheral surfaces, which protrude outwardly. The rings 18 and 19 are slidable relative to the casing 15 and suction tube 16, respectively.

The inner peripheral surfaces of the impeller casing 15 and suction tube 16 which contact the upper ring 18 and lower ring 19 are provided with concave surfaces which may fit or are complementary to the convex surfaces of the upper ring 18 and the lower ring 19.

The upper ring 18 and lower ring 19 are fitted in the impeller casing 15 and suction tube 16 according to shrink fit, i.e., the concave spherical surfaces of the impeller casing 15 and suction tube 16 and the neighborhood thereof are heated beforehand, and then the upper ring 18 and lower ring 19 are fitted in the aforesaid concave spherical surfaces, after which the impeller casing 15 and suction tube 16 are cooled. The upper ring 18 and lower ring 19 may be rotatable through a given angle so as to permit the automatic centering along their contacting surfaces with the impeller casing 15 and suction tube 16.

With the embodiment of the aforesaid arrangement, the upper ring and lower ring may effect automatic centering along the bearing surfaces, thus facilitating set-up, assembly and adjustment of a pump.

What is claimed is:

1. A turbine pump for molten sodium, having an elongated cylindrical casing, comprising:

a shaft;

an impeller including a crown ring, mouth ring and vanes arranged radially and secured to said crown ring and said mouth ring therebetween, said crown ring being secured to one end of a shaft and formed with a cylindrical impeller ring extending along said shaft in concentric relation thereto;

an impeller casing, through which said shaft extends, said impeller casing providing a given clearance to said crown ring and said impeller ring;

a suction tube positioned in the close proximity of said mouth ring and surrounding same, for introducing molten sodium from externally of said casing into said impeller;

an upper ring positioned on a surface of said impeller casing, which faces said impeller ring, with a clearance between said upper ring and the outer peripheral surface of the impeller ring, the clearance serving as a static pressure bearing with molten sodium used as a lubricant;

a lower ring positioned on a surface of said suction tube, which faces said mouth ring, with a clearance between said lower ring and the outer peripheral surface of the suction tube, the clearance serving as a static pressure bearing with molten sodium used as a lubricant.

2. A turbine pump as set forth in claim 1, wherein said pump further comprises:

two or more pockets provided on the outer peripheral surface of said impeller ring, which faces said upper ring with the lower end thereof extending to a position lower than the lower edge of said upper ring, as well as on the outer peripheral surface of said mouth ring, which faces said lower ring with the upper end thereof extending to a position higher than the upper edge of said lower ring.

3. A turbine pump as set forth in claim 2, wherein said pockets are provided in two sets, same in dimensions and same in number, said pockets being arranged equiangularly in the circumferential direction, and said two sets of pockets being angularly shifted half an equiangular division.

4. A turbine pump as set forth in claim 1, wherein the contacting surfaces of said upper ring and said impeller casing are formed as spherical surfaces, and the contacting surfaces of said lower ring and said suction tube are formed as spherical surfaces, said upper ring and said lower ring being slidable on said impeller casing and said suction tube, respectively.

5. A turbine pump as set forth in claim 4, wherein two or more pockets are provided on the outer peripheral surface of said impeller ring, which faces said upper ring with the lower end thereof extending to a position lower than the lower edge of said upper ring, as well as on the outer peripheral surface of said mouth ring, which faces said lower ring with the upper end thereof extending to a position higher than the upper edge of said lower ring.

6. A turbine pump as set forth in claim 4, wherein said pockets are provided in two sets, same in dimensions and same in number, said pockets being arranged equiangularly in the circumferential direction, and said two sets of pockets being angularly shifted half an equiangular division.

7. A turbine pump for molten sodium, having an elongated cylindrical casing, comprising:

a shaft;

an impeller including a crown ring, mouth ring and two or more vanes arranged radially and secured to said crown ring and said mouth ring therebetween, said crown ring having a cylindrical boss portion and a cylindrical impeller ring extending along said shaft in concentric relation thereto, and the outer peripheral surfaces of said impeller and said mouth ring being provided with two or more pockets;

an impeller casing including a cylindrical portion, a flange portion extending from one edge of said cylindrical portion radially outwardly, and a pan-shaped portion extending from the other edge of said cylindrical portion both radially outwardly and inwardly and having a through-hole in its center portion for admitting said shaft therein, said cylindrical portion having a diameter large enough for surrounding said impeller ring from outwardly in the close proximity of said impeller ring, and the outer peripheral edge of said pan-shaped portion being positioned in the close proximity of said casing;

an upper ring secured to the inner peripheral surface of said cylindrical portion of said impeller casing which faces said impeller ring and maintaining a clearance between said upper ring and the outer peripheral surface of said impeller ring, said clearance serving as a static pressure bearing, with molten sodium used as a lubricant;

a suction tube, whose upper edge portion faces said mouth ring in surrounding relation thereto, and whose lower edge portion is communicated with a sodium inlet nozzle;

a lower ring secured to the surface of said suction tube, which faces said mouth ring, said maintaining a clearance between said lower ring and the outer peripheral surface of said mouth ring, said clearance serving as a static pressure bearing, with molten sodium used as a lubricant;

a diffuser positioned in the close vicinity of the outer peripheral portion of said impeller and having upper and lower edge portions secured to a flange portion of said impeller casing and said suction tube, respectively, said diffuser diffusing molten sodium being discharged due to the rotation of said impeller, towards an outlet nozzle provided in said casing; and an inner casing whose lower edge is secured to said pan-shaped portion of said impeller casing, and whose upper edge is secured to said casing, said inner casing being of a cylindrical shape, and an assembly consisting of said impeller casing, diffuser and suction tube being suspended from said inner casing within said casing.

8. A turbine pump for molten sodium, having an elongated cylindrical casing, comprising:

a shaft;

an impeller including a crown ring, mouth ring and two or more vanes arranged radially and secured to said crown ring and said mouth ring therebetween, said crown ring having a cylindrical boss portion and a cylindrical impeller ring extending along said shaft in concentric relation thereto, and the outer peripheral surfaces of said impeller and said mouth ring being provided with two or more pockets;

an impeller casing including a cylindrical portion, a flange portion extending from one edge of said cylindrical portion radially outwardly, and a pan-shaped portion extending from the other edge of said cylindrical portion both radially outwardly and inwardly, and having a through-hole in its center portion for admitting said shaft therein, said cylindrical portion having a diameter large enough for surrounding said impeller ring from outwardly in the close proximity of said impeller ring, the outer peripheral edge of said pan-shaped portion being positioned in the close proximity of said casing, and part of the inner peripheral surface of said cylindrical portion being provided with a concave spherical surface;

an upper ring having a convex spherical surface which may slidably fit the concave spherical surface provided on the inner peripheral surface of said cylindrical portion of said impeller casing, and said upper ring maintaining a clearance between said upper ring and the outer peripheral surface of said impeller ring, said clearance serving as a static pressure bearing, with molten sodium used as lubricant;

a suction tube whose upper edge portion faces said mouth ring in surrounding relation thereto, and whose lower edge portion is communicated with a sodium inlet nozzle, part of the inner peripheral surface of said suction tube, which faces said mouth ring, being provided with a concave spherical surface;

a lower ring having a convex spherical surface which slidably fits the concave spherical surface provided on said suction tube, said lower ring maintaining a clearance between said lower ring and the outer peripheral surface of said mouth ring, and said clearance serving as a static pressure bearing, with molten sodium used as a lubricant;

a diffuser positioned in the close vicinity of the outer peripheral portion of said impeller and having upper and lower edge portions secured to a flange portion of said impeller casing and said suction tube, respectively, said diffuser diffusing molten sodium being discharged due to the rotation of said impeller, towards an outlet nozzle provided in said casing; and an inner casing, whose lower edge is secured to said pan-shaped portion of said impeller casing, and whose upper edge is secured to said casing, and said inner casing being of a cylindrical shape, and an assembly consisting of said impeller casing, diffuser and suction tube being suspended from said inner casing within said casing.

9. A turbine pump for molten sodium, having a casing comprising:

a shaft;

an impeller secured to said shaft, said impeller having a first and second end portions with vanes extending therebetween;

an impeller casing positioned opposite the first end portion of said impeller with clearance therebetween;

a suction tube positioned opposite the second end portion of said impeller with clearance therebetween for introducing molten sodium from externally of said casing into said impeller;

a first ring positioned on a surface of said impeller casing, which faces said first end portion of said impeller, with a clearance between said first ring and the first end portion of said impeller, the clearance serving as a static pressure bearing with molten sodium used as a lubricant;

a second ring, positioned on a surface of the suction tube, which faces said second end portion of said impeller, with a clearance between said second ring and the second end portion of said impeller, the clearance serving as a static pressure bearing with molten sodium used as a lubricant.

* * * * *